US008442407B2

(12) United States Patent
Willard et al.

(10) Patent No.: US 8,442,407 B2
(45) Date of Patent: May 14, 2013

(54) METHODS, APPARATUS AND SYSTEMS TO CONTROL THE TRIBO-ELECTRIC CHARGE OF A TONER MATERIAL ASSOCIATED WITH A PRINTING DEVELOPMENT SYSTEM

(75) Inventors: W. Bradford Willard, Fairport, NY (US); Kimberly Anne Stoll, Penfield, NY (US); David R. Stookey, Walworth, NY (US); Paul L. Jacobs, Webster, NY (US); Robert W. Phelps, Victor, NY (US); Jyothsna Ram, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 196 days.

(21) Appl. No.: 12/844,167

(22) Filed: Jul. 27, 2010

(65) Prior Publication Data

US 2012/0028173 A1 Feb. 2, 2012

(51) Int. Cl.
*G03G 15/00* (2006.01)

(52) U.S. Cl.
USPC ..... 399/44; 399/94; 399/97; 399/290

(58) Field of Classification Search ..... 399/44, 399/94, 97, 290
See application file for complete search history.

(56) References Cited

U.S. PATENT DOCUMENTS

| | | | | |
|---|---|---|---|---|
| 5,124,749 | A | 6/1992 | Bares | |
| 5,666,619 | A | 9/1997 | Hart et al. | |
| 6,788,904 | B2 | 9/2004 | York | |
| 6,941,089 | B2 | 9/2005 | Rivera et al. | |
| 6,963,704 | B2 | 11/2005 | Hunter et al. | |
| 6,980,751 | B2 | 12/2005 | Wayman et al. | |
| 7,076,193 | B2 | 7/2006 | Wing et al. | |
| 7,171,136 | B2 | 1/2007 | Wayman | |
| 7,532,830 | B2 | 5/2009 | Kumar et al. | |
| 7,580,648 | B2 | 8/2009 | Shaw et al. | |
| 2005/0084280 | A1 * | 4/2005 | Hunter et al. | 399/94 |
| 2008/0112716 | A1 * | 5/2008 | Jeschonek | 399/44 |

OTHER PUBLICATIONS

U.S. Appl. No. 12/821,513, filed Jun. 23, 2010, Willard et al.

* cited by examiner

*Primary Examiner* — Walter L Lindsay, Jr.
*Assistant Examiner* — Roy Y Yi
(74) *Attorney, Agent, or Firm* — Fay Sharpe LLP

(57) ABSTRACT

Disclosed are printing methods, apparatus and systems for developing a latent image recorded on a surface, for example, a photoreceptor with developer material. According to an exemplary embodiment, the development method applies a development field voltage between a development station donor member and a development station transport member as a function of a humidity measurement associated with the developer material, the humidity measurement providing a surrogate tribo measurement of the developer material.

20 Claims, 9 Drawing Sheets

METHODS, APPARATUS AND SYSTEMS TO CONTROL THE TRIBO-ELECTRIC CHARGE OF A TONER MATERIAL ASSOCIATED WITH A PRINTING DEVELOPMENT SYSTEM

CROSS REFERENCE TO RELATED PATENTS AND APPLICATIONS

U.S. patent application Ser. No. 12/821,513, filed Jun. 23, 2010, by W. Bradford Willard et al., entitled "METHODS, APPARATUS AND SYSTEMS TO CONTROL THE DONOR ROLL TO MAG ROLL DEVELOPMENT FIELD (VDM) ASSOCIATED WITH A PRINTING DEVELOPMENT SYSTEM" is totally incorporated herein by reference in its entirety.

BACKGROUND

Generally, the process of electrophotographic printing includes charging a photoconductive member to a substantially uniform potential to sensitize the surface thereof. The charged portion of the photoconductive surface is exposed to a light image from either a scanning laser beam, an LED source, or an original document being reproduced. This records an electrostatic latent image on the photoconductive surface. After the electrostatic latent image is recorded on the photoconductive surface, the latent image is developed. Two-component and single-component developer materials are commonly used for development. A typical two-component developer comprises magnetic carrier granules having toner particles tribo-electrically charged and adhering thereto. A single-component developer material typically comprises toner particles. Toner particles are attracted to the latent image, forming a toner powder image on the photoconductive surface. The toner powder image is subsequently transferred to a copy sheet. Finally, the toner powder image is heated to permanently fuse it to the copy sheet in image configuration.

The electrophotographic marking process given above can be modified to produce color images. For example, a color electrophotographic marking process, called image-on-image (IOI) processing, superimposes toner powder images of different color toners onto the photoreceptor prior to the transfer of the composite toner powder image onto the substrate. While the IOI process provides certain benefits, such as a compact architecture, there are several challenges to its successful implementation. For instance, the viability of printing system concepts such as IOI processing requires development systems that do not interact with a previously toned image. Since several known development systems, such as conventional magnetic brush development and jumping single-component development, interact with the image on the receiver, a previously toned image will be scavenged by subsequent development if interacting development systems are used. Thus, for the IOI process, there is a need for scavengeless or noninteractive development systems.

Hybrid scavengeless development technology develops toner via a conventional magnetic brush onto the surface of a donor roll and a plurality of electrode wires are closely spaced from the toned donor roll in the development zone. An AC voltage is applied to the wires to generate a toner cloud in the development zone. This donor roll generally consists of a conductive core covered with a thin (50-200 micron) partially conductive layer. The magnetic brush roll is held at an electrical potential difference relative to the donor core to produce the field necessary for toner development. The toner layer on the donor roll is then disturbed by electric fields from a wire or set of wires to produce and sustain an agitated cloud of toner particles. Typical AC voltages of the wires relative to the donor are 700-900 Vpp at frequencies of 5-15 kHz. These AC signals are often square waves, rather than pure sinusoidal waves. Toner from the cloud is then developed onto the nearby photoreceptor by fields created by a latent image.

Two-Component developer typically consists of 5-15 micron insulating toner particles, which are mixed with 50-100 micron conductive magnetic carrier granules. The developer material may comprise from about 95% to about 99% by weight of carrier and from 5% to about 1% by weight of toner.

The mixing of the developer material generates toner charge through tribo-electrification with the carrier granules.

It is well known that tribo-electrification is strongly influenced by the environmental conditions, specifically the Relative Humidity. At low RH the toner tribo-electric charge will be higher in magnitude and at high RH the toner will be lower in charge magnitude.

To maintain optimum image quality it is desirable to control the toner charge within an optimum range. To do this environmental controls are typically required to maintain the machine's ambient temperature and relative humidity. In the past, Manufacturers have put limits on the acceptable customer temperature and RH extremes before installing machines. If a location is outside the specified limits, then the customer is notified that he must install/upgrade his HVAC system or find a more suitable location.

However HVAC control is expensive and may not be available or viable in some customer locations.

One existing printing system uses electric heat pads to provide heat to each developer housing independently, allowing for station unique temperature control, see U.S. Pat. No. 6,941,089, by Rivera et al., entitled "Heating System for a Developer Housing," issued Sep. 6, 2005.

The unique approach disclosed herein is moving the developer housing target setpoint itself as a function of ambient grains of water. This provides for increased tribo performance across a wider range of humidity conditions and for systems that experience significant changes in humidity during both operation and standby.

INCORPORATION BY REFERENCE

U.S. Pat. No. 7,580,648 to Shaw et al., entitled "SYSTEMS AND METHODS FOR MOMENTUM CONTROLLED SCAVENGELESS JUMPING DEVELOPMENT IN ELECTROPHOTOGRAPHIC MARKING DEVICES," issued Aug. 25, 2009.

U.S. Pat. No. 7,532,830 to Kumar et al., entitled "ENVIRONMENTAL CONTROLS FOR OPERATION OF AN ELECTROSTATOGRAPHIC DEVELOPER UNIT HAVING MULTIPLE MAGNETIC BRUSH ROLLS," issued May 12, 2009.

U.S. Pat. No. 7,076,193 to Wing et al., entitled "WIRE MODULE FOR DEVELOPER UNIT," issued Jul. 11, 2006.

U.S. Pat. No. 6,980,751 by Wayman et al., entitled "DEVELOPER HUMIDIFIER," issued Dec. 27, 2005.

U.S. Pat. No. 6,941,089 to Rivera et al., entitled "HEATING SYSTEM FOR A DEVELOPER HOUSING," issued Sep. 6, 2005.

U.S. Pat. No. 6,788,904 to York, entitled "CLIMATE CONTROL SYSTEM FOR DEVELOPER MATERIAL IN A DEVELOPER HOUSING," issued Sep. 7, 2004.

U.S. Pat. No. 5,666,619 to Hart et al., entitled "ELECTRODE WIRE SUPPORT FOR SCAVENGELESS DEVELOPMENT," issued Sep. 9, 1997.

U.S. Pat. No. 5,124,749 to Bares, entitled "DAMPING ELECTRODE WIRES OF A DEVELOPER UNIT," issued Jun. 23, 1992.

BRIEF DESCRIPTION

In one embodiment of this disclosure, described is a method of developing a latent image recorded on a surface using a development system, the development system including a chamber storing a supply of developer material therein, a transport member, a donor member, an electrode wire, a temperature control system configured to control a temperature associated with the developer material to a target temperature and a humidity sensor configured to measure the humidity associated with the developer material, wherein the transport member is configured to transport the developer material to the donor member, and the donor member and electrode wire are configured to form a cloud of developer material in a space between the electrode wire and the surface to develop the latent image on the surface, the method comprising a) measuring the humidity associated with the developer material; b) the temperature control system controlling the temperature of the developer material as a function of the measured humidity, the temperature of the developer material being increased as the measured humidity increases thereby increasing a tribo-electric charge associated with the development material within the chamber, and the temperature of the developer material being decreased as the measured humidity decreases thereby decreasing the tribo-electric charge associated with the developer material within the chamber; c) mixing the developer material with magnetic carrier granules, thereby producing a tribo-electrically charged developer material; d) magnetically transporting the developer material from the chamber to the transport roll; e) transporting the developer material from the transport roll to the donor roll by applying a development field voltage (Vdm) between the donor member and the transport member; and f) electrically biasing the electrode wire to detach the developer material from the donor roll to form the cloud of developer material in the space between the electrode wire and the surface to develop the latent image.

In another embodiment of this disclosure, described is an apparatus for developing a latent image recorded on a surface comprising a housing defining a chamber storing a supply of developer material therein; a transport member operatively associated with the chamber and configured to attract the developer material to a surface of the transport member; a donor member operatively associated with the transport member and configured to attract developer material from the surface of the transport member to a surface of the donor member; an electrode wire operatively associated with the donor member and the surface, the electrode wire, donor member and surface configured to transfer developer material from the donor member to the surface, the electrode wire positioned between the donor member and the surface; a humidity sensor configured to measure the humidity associated with the developer material; a temperature control system configured to control a temperature associated with the developer material to a target temperature; and a controller configured to execute instructions to perform a method of developing a latent image recorded on a surface, the method comprising a) measuring the humidity associated with the developer material; b) the temperature control system controlling the temperature of the developer material as a function of the measured humidity, the temperature of the developer material being increased as the measured humidity increases thereby increasing a tribo-electric charge associated with the development material within the chamber, and the temperature of the developer material being decreased as the measured humidity decreases thereby decreasing the tribo-electric charge associated with the developer material within the chamber; c) mixing the developer material with magnetic carrier granules, thereby producing a tribo-electrically charged developer material; d) magnetically transporting the developer material from the chamber to the transport roll; e) transporting the developer material from the transport roll to the donor roll by applying a development field voltage (Vdm) between the donor member and the transport member; and f) electrically biasing the electrode wire to detach the developer material from the donor roll to form the cloud of developer material in the space between the electrode wire and the surface to develop the latent image.

In still another embodiment of this disclosure, described is a xerographic printing system comprising a photoreceptor member; a raster output scanner (ROS) that generates a latent image on a portion of the photoreceptor member as it moves past the ROS; a development station for developing the latent image with a developer material to produce a developed image, the development station comprising an image transfer station for transferring the developed image to a substrate; a housing defining a chamber storing a supply of the developer material therein; a transport member operatively associated with the chamber and configured to attract the developer material to a surface of the transport member; a donor member operatively associated with the transport member and configured to attract developer material from the surface of the transport member to a surface of the donor member; an electrode wire operatively associated with the donor member and the photoreceptor member, the electrode wire, donor member and photoreceptor member configured to transfer the developer material from the donor member to the photoreceptor surface, the electrode wire positioned between the donor member and the photoreceptor; and a humidity sensor configured to measure the humidity associated with the developer material; a temperature control system configured to control a temperature associated with the developer material to a target temperature; and a controller configured to execute instructions to perform a method of developing a latent image recorded on a surface, the method comprising a) measuring the humidity associated with the developer material; b) the temperature control system controlling the temperature of the developer material as a function of the measured humidity, the temperature of the developer material being increased as the measured humidity increases thereby increasing a tribo-electric charge associated with the development material within the chamber, and the temperature of the developer material being decreased as the measured humidity decreases thereby decreasing the tribo-electric charge associated with the developer material within the chamber; c) mixing the developer material with magnetic carrier granules, thereby producing a tribo-electrically charged developer material; d) magnetically transporting the developer material from the chamber to the transport roll; e) transporting the developer material from the transport roll to the donor roll by applying a development field voltage (Vdm) between the donor member and the transport member; and f) electrically biasing the electrode wire to detach the developer material from the donor roll to form the cloud of developer material in the space between the electrode wire and the surface to develop the latent image; a transfer station for transferring the developer material from the photoreceptor to a substrate; and a fusing station configured to fuse the transferred developer material to the substrate.

DETAILED DESCRIPTION

As previously stated in the background, this disclosure, and the exemplary embodiments included herein, provide printing methods, apparatus and systems to control the donor roll to mag roll development field (Vdm) as a function of the environment associated with a toner material utilized to develop a latent image recorded on a photoreceptor surface. The developed image is subsequently transferred to another substrate which may be, but not limited to, a paper sheet.

According to one aspect of this disclosure, provided is a method to update the Vdm based on a change in absolute humidity or grains of water (GOW). The change in Vdm is a function of the relationship between GOW and toner tribo-tribo goes down as GOW goes up. By adjusting the donor roll to mag roll development field (Vdm) as a function of GOW, the toner mass developed to the donor roll can be kept more constant, thereby resulting in a more consistent bed of toner entering a hybrid scavengeless development (HSD) wire area, and hence more consistent development to the photoreceptor (P/R) surface and more consistent prints.

According to another aspect of this disclosure, a method to control the temperature of a developer housing as a function of GOW is disclosed, whereby the developer housing temperature setpoint is selected to maintain the tribo operating latitude associated with the developer housing. Importantly, the GOW associated with the developer housing is utilized as a surrogate measurement of the tribo-electric charge associated with the toner particles within the developer housing.

Figure 1:
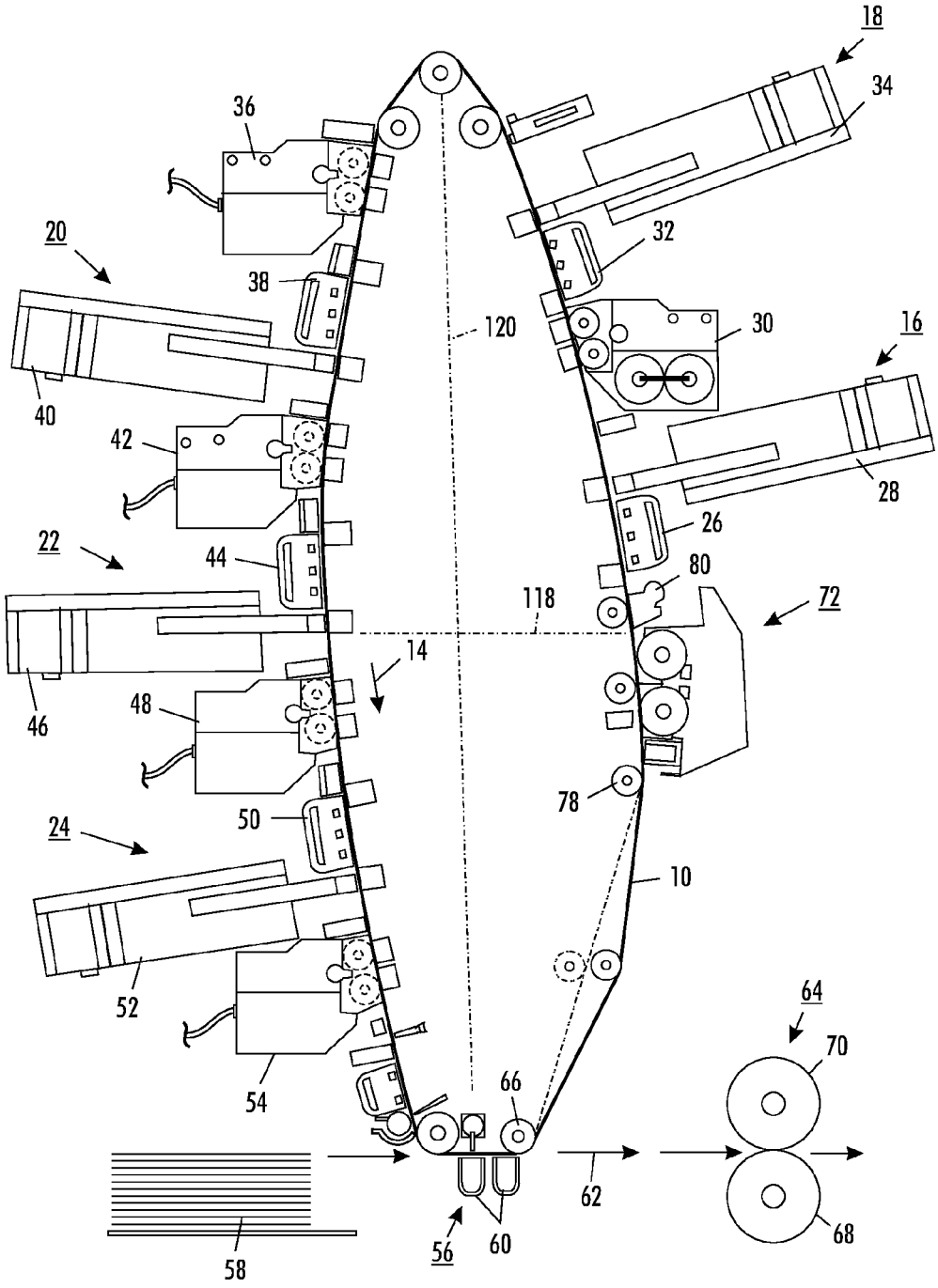
FIG. 1 is a schematic view of a single pass multicolor electrophotographic printing device.

Referring now to FIG. 1, there is shown a single pass multi-color printing machine according to an exemplary embodiment of this disclosure. This printing machine employs a photoconductive belt 10, supported by a plurality of rollers or bars. Photoconductive belt 10 is arranged in a vertical orientation. Photoconductive belt 10 advances in the direction of arrow 14 to move successive portions of the external surface of photoconductive belt 10 sequentially beneath the various processing stations disposed about the path of movement thereof. The photoconductive belt has a major axis 120 and a minor axis 118. The major and minor axes are perpendicular to one another. Photoconductive belt 10 is elliptically shaped. The major axis 120 is substantially parallel to the gravitational vector and arranged in a substantially vertical orientation. The minor axis 118 is substantially perpendicular to the gravitational vector and arranged in a substantially horizontal direction. The printing machine architecture includes five image recording stations indicated generally by the reference numerals 16, 18, 20, 22, and 24, respectively, however it is to be understood the disclosed method of controlling the donor roll to mag roll development field (Vdm) is applicable to any number of recording stations associated with a printing machine (i.e., printing device, printing engine, printing apparatus, etc.). Initially, photoconductive belt 10 passes through image recording station 16. Image recording station 16 includes a charging device and an exposure device. The charging device includes including a corona generator 26 that charges the exterior surface of photoconductive belt 10 to a relatively high, substantially uniform potential. After the exterior surface of photoconductive belt 10 is charged, the charged portion thereof advances to the exposure device. The exposure device includes a raster output scanner (ROS) 28, which illuminates the charged portion of the exterior surface of photoconductive belt 10 to record a first electrostatic latent image thereon. Alternatively, a light emitting diode (LED) may be used.

This first electrostatic latent image is developed by developer unit 30. Developer unit 30 deposits toner particles of a selected color on the first electrostatic latent image. After the highlight toner image has been developed on the exterior surface of photoconductive belt 10, belt 10 continues to advance in the direction of arrow 14 to image recording station 18.

Image recording station 18 includes a recharging device and an exposure device. The charging device includes a corona generator 32 which recharges the exterior surface of photoconductive belt 10 to a relatively high, substantially uniform potential. The exposure device includes a ROS 34 which illuminates the charged portion of the exterior surface of photoconductive belt 10 selectively to record a second electrostatic latent image thereon. This second electrostatic latent image corresponds to the regions to be developed with magenta toner particles. This second electrostatic latent image is now advanced to the next successive developer unit 36.

Developer unit 36 deposits magenta toner particles on the electrostatic latent image. In this way, a magenta toner powder image is formed on the exterior surface of photoconductive belt 10. After the magenta toner powder image has been developed on the exterior surface of photoconductive belt 10, photoconductive belt 10 continues to advance in the direction of arrow 14 to image recording station 20.

Image recording station 20 includes a charging device and an exposure device. The charging device includes corona generator 38, which recharges the photoconductive surface to a relatively high, substantially uniform potential. The exposure device includes ROS 40 which illuminates the charged portion of the exterior surface of photoconductive belt 10 to selectively dissipate the charge thereon to record a third electrostatic latent image corresponding to the regions to be developed with yellow toner particles. This third electrostatic latent image is now advanced to the next successive developer unit 42.

Developer unit 42 deposits yellow toner particles on the exterior surface of photoconductive belt 10 to form a yellow toner powder image thereon. After the third electrostatic latent image has been developed with yellow toner, photoconductive belt 10 advances in the direction of arrow 14 to the next image recording station 22.

Image recording station 22 includes a charging device and an exposure device. The charging device includes a corona generator 44, which charges the exterior surface of photoconductive belt 10 to a relatively high, substantially uniform potential. The exposure device includes ROS 46, which illuminates the charged portion of the exterior surface of photoconductive belt 10 to selectively dissipate the charge on the exterior surface of photoconductive belt 10 to record a fourth electrostatic latent image for development with cyan toner particles. After the fourth electrostatic latent image is recorded on the exterior surface of photoconductive belt 10, photoconductive belt 10 advances this electrostatic latent image to the magenta developer unit 48.

Cyan developer unit 48 deposits magenta toner particles on the fourth electrostatic latent image. These toner particles may be partially in superimposed registration with the previously formed yellow powder image. After the cyan toner powder image is formed on the exterior surface of photoconductive belt 10, photoconductive belt 10 advances to the next image recording station 24.

Image recording station 24 includes a charging device and an exposure device. The charging device includes corona generator 50 which charges the exterior surface of photoconductive belt 10 to a relatively high, substantially uniform potential. The exposure device includes ROS 52, which illuminates the charged portion of the exterior surface of photoconductive belt 10 to selectively discharge those portions of the charged exterior surface of photoconductive belt 10 which are to be developed with black toner particles. The fifth electrostatic latent image, to be developed with black toner particles, is advanced to black developer unit 54.

At black developer unit 54, black toner particles are deposited on the exterior surface of photoconductive belt 10. These black toner particles form a black toner powder image which may be partially or totally in superimposed registration with the previously formed yellow and magenta toner powder images. In this way, a multi-color toner powder image is formed on the exterior surface of photoconductive belt 10. Thereafter, photoconductive belt 10 advances the multi-color toner powder image to a transfer station, indicated generally by the reference numeral 56.

At transfer station 56, a receiving medium 58, i.e., paper, is advanced from stack 58 by sheet feeders and guided to transfer station 56. At transfer station 56, a corona generating device 60 sprays ions onto the backside of the paper. This attracts the developed multi-color toner image from the exterior surface of photoconductive belt 10 to the sheet of paper. Stripping assist roller 67 contacts the interior surface of photoconductive belt 10 and provides a sufficiently sharp bend thereat so that the beam strength of the advancing paper strips from photoconductive belt 10. A vacuum transport moves the sheet of paper in the direction of arrow 62 to fusing station 64.

Fusing station 64 includes a heated fuser roller 70 and a backup roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multi-color image thereon. After fusing, the finished sheet is discharged to a finishing station where the sheets are compiled and formed into sets which may be bound to one another. These sets are then advanced to a catch tray for subsequent removal therefrom by the printing machine operator.

One skilled in the art will appreciate that while the multi-color developed image has been disclosed as being transferred to paper, it may be transferred to an intermediate member, such as a belt or drum, and then subsequently transferred and fused to the paper. Furthermore, while toner powder images and toner particles have been disclosed herein, one skilled in the art will appreciate that a liquid developer material employing toner particles in a liquid carrier may also be used.

Invariably, after the multi-color toner powder image has been transferred to the sheet of paper, residual toner particles remain adhering to the exterior surface of photoconductive belt 10. The photoconductive belt 10 moves over isolation roller 78 which isolates the cleaning operation at cleaning station 72. At cleaning station 72, the residual toner particles are removed from photoconductive belt 10. Photoconductive belt 10 then moves under spots blade 80 to also remove toner particles therefrom.

Figure 2:
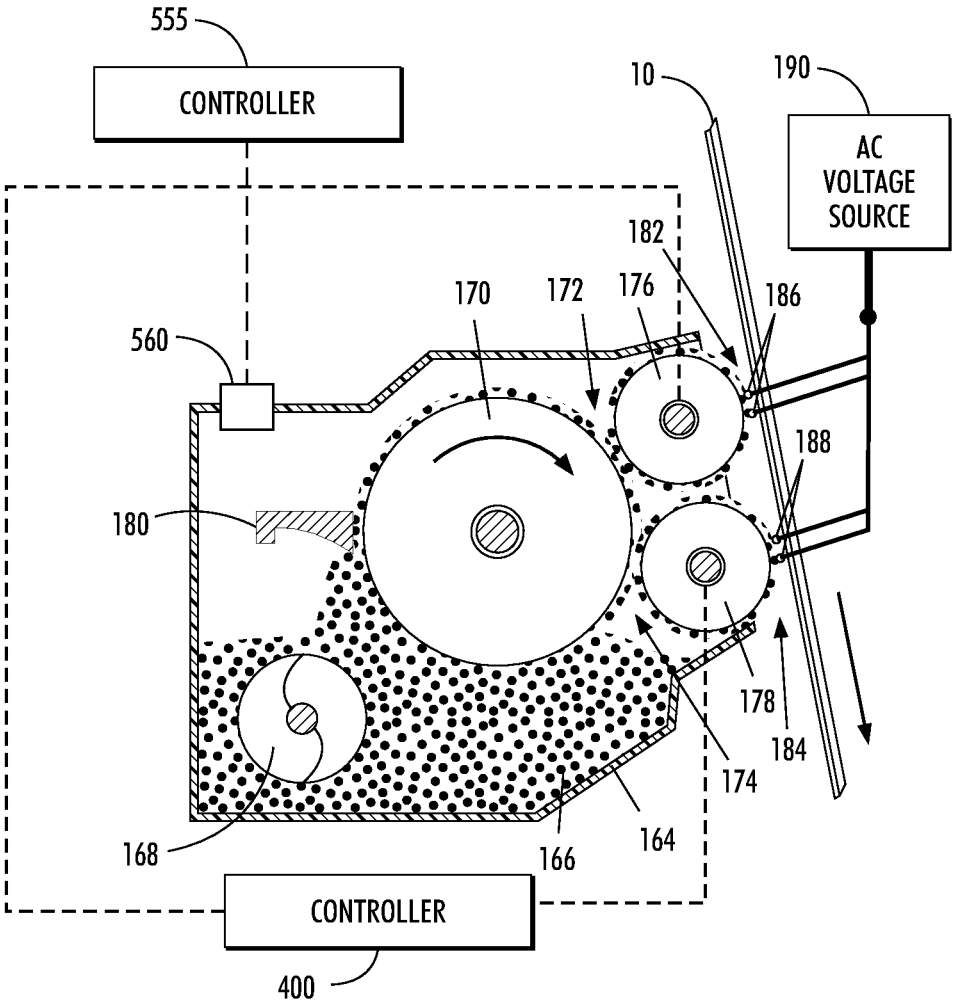
FIG. 2 is a schematic elevation view of a development apparatus according to an exemplary embodiment of this disclosure.

Referring now to FIG. 2, there are shown the details of a development apparatus according to an exemplary embodiment of this disclosure. The apparatus comprises a reservoir 164 containing developer material 166. The developer material 166 is of the two component type, that is, it comprises carrier granules and toner particles. The reservoir includes augers, indicated at 168, which are rotatably-mounted in the reservoir chamber. The augers 168 serve to transport and to agitate the material within the reservoir and encourage the toner particles to charge tribo-electrically and adhere to the carrier granules. A magnetic brush roll 170 transports developer material from the reservoir to the loading nips 172, 174 of two donor rolls 176, 178. Magnetic brush rolls are well known, so the construction of roll 170 need not be described in great detail. Briefly the roll comprises a rotatable tubular housing within which is located a stationary magnetic cylinder having a plurality of magnetic poles impressed around its surface. The carrier granules of the developer material are magnetic and, as the tubular housing of the roll 170 rotates, the granules (with toner particles adhering tribo-electrically thereto) are attracted to the roll 170 and are conveyed to the donor roll loading nips 172, 174. A metering blade 180 removes excess developer material from the magnetic brush roll and ensures an even depth of coverage with developer material before arrival at the first donor roll loading nip 172. At each of the donor roll loading nips 172, 174, toner particles are transferred from the magnetic brush roll 170 to the respective donor roll 176, 178.

Each donor roll transports the toner to a respective development zone 182, 184 through which the photoconductive belt 10 passes. Transfer of toner from the magnetic brush roll 170 to the donor rolls 176, 178 can be encouraged by, for example, the application of a suitable D.C. electrical bias to the magnetic brush and/or donor rolls. The D.C. bias (for example, approximately 20-100 Volts applied to the magnetic roll) establishes an electrostatic field between the donor roll and magnetic brush rolls, which causes toner particles to be attracted to the donor roll from the carrier granules on the magnetic roll.

The carrier granules and any toner particles that remain on the magnetic brush roll 170 are returned to the reservoir 164 as the magnetic brush continues to rotate. The relative amounts of toner transferred from the magnetic roll 170 to the donor rolls 176, 178 can be adjusted, for example by: applying different bias voltages to the donor rolls; adjusting the magnetic to donor roll spacing; adjusting the strength and shape of the magnetic field at the loading nips and/or adjusting the speeds of the donor rolls.

At each of the development zones 182, 184, toner is transferred from the respective donor roll 176, 178 to the latent image on the belt 10 to form a toner powder image on the latter.

In FIG. 2, each of the development zones 182, 184 is shown as having the form i.e. electrode wires are disposed in the space between each donor roll 176, 178 and photoconductive belt 10. FIG. 2 shows, for each donor roll 176, 178, a respective pair of electrode wires 186, 188 extending in a direction substantially parallel to the longitudinal axis of the donor roll. The electrode wires are made from thin (i.e. 50 to 100 micron diameter) stainless steel wires which are closely spaced from the respective donor roll. The wires are self-spaced from the donor rolls by the thickness of the toner on the donor rolls. The distance between each wire and the respective donor roll is within the range from about 5 micron to about 20 micron (typically about 10 micron) or the thickness of the toner layer on the donor roll. An alternating electrical bias is applied to the electrode wires by an AC voltage source 190.

The applied AC establishes an alternating electrostatic field between each pair of wires and the respective donor roll, which is effective in detaching toner from the surface of the donor roll and forming a toner cloud about the wires, the height of the cloud being such as not to be substantially in contact with the belt 10. The magnitude of the AC voltage in the order of 200 to 500 volts peak at frequency ranging from about 8 kHz to about 16 kHz. A DC bias supply (not shown) applied to each donor roll 176, 178 establishes electrostatic fields between the photoconductive belt 10 and donor rolls for attracting the detached toner particles from the clouds surrounding the wires to the latent image recorded on the photoconductive surface of the belt.

As successive electrostatic latent images are developed, the toner particles within the developer material 166 are depleted. A toner dispenser (not shown) stores a supply of toner particles. The toner dispenser is in communication with reservoir 164 and, as the concentration of toner particles in the developer material is decreased, fresh toner particles are furnished to the developer material in the reservoir. The auger 168 in the reservoir chamber mixes the fresh toner particles with the remaining developer material so that the resultant developer material therein is substantially uniform with the concentration of toner particles being optimized. In this way, a substantially constant amount of toner particles is in the reservoir with the toner particles having a constant charge.

The two-component developer 166 used in the apparatus of FIG. 2 may be of any suitable type. However, the use of an electrically conductive developer is preferred because it eliminates the possibility of charge build-up within the developer material on the magnetic brush roll which, in turn, could adversely affect development at the second donor roll. By way of example, the carrier granules of the developer material may include a ferromagnetic core having a thin layer of magnetite overcoated with a non-continuous layer of resinous material. The toner particles may be made from a resinous material, such as a vinyl polymer, mixed with a coloring material, such as chromogen black. The developer material may comprise from about 95% to about 99% by weight of carrier and from 5% to about 1% by weight of toner.

With continuing reference to FIG. 2, now is described an exemplary method of controlling Vdm as a function of a surrogate tribo-electric measurement, i.e., the measurement of development toner humidity by humidity sensor 560. In operation, controller 400 receives a relative or absolute humidity measurement from humidity sensor 560 and subsequently, the controller 400 controls the voltage of the donor rolls 176 and 178, relative to magnetic brush roll 170, as a function of the measured humidity.

Figure 3:
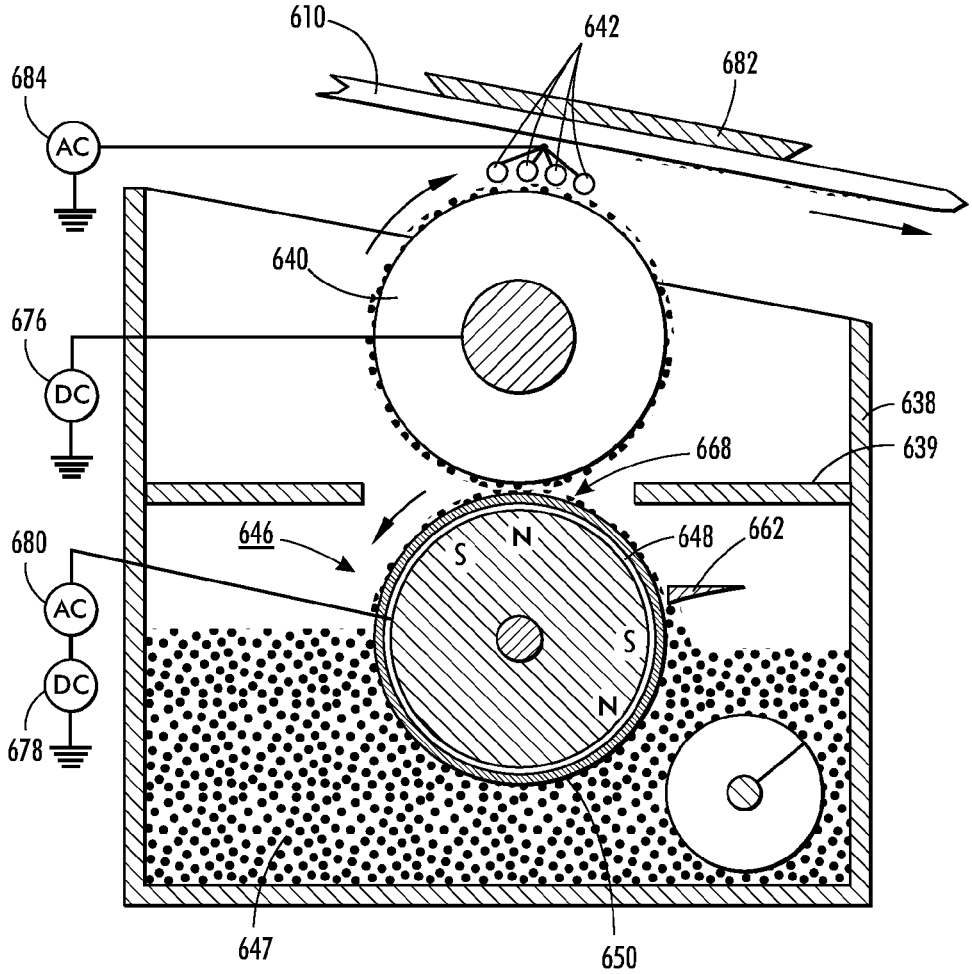
FIG. 3 is a simplified elevational view of a hybrid scavengeless development station.

Referring now to FIG. 3, there is shown a hybrid-scavengeless development system according to another exemplary embodiment of this disclosure in greater detail. This HSD development system only includes one donor roll 640, however, the disclosed Vdm control methods are equally applicable. Housing 638 defines a chamber for storing a supply of developer material 647 therein. A housing shelf 639 separates the developer housing into two sections; one associated with the donor roll and the other associated with the transport roll 646. Positioned in the bottom of housing 638 is a horizontal auger which distributes developer material uniformly along the length of transport roll 646, so that the lowermost part of roll 646 is always immersed in a body of developer material.

Transport roll 646 comprises a stationary multi-polar magnet 648 having a closely spaced sleeve 650 of non-magnetic material, preferably aluminum, designed to be rotated about the magnetic core 648 in a direction indicated by the arrow. Because the developer material includes magnetic carrier granules, the effect of the sleeve rotating through stationary magnetic fields is to cause developer material to be attracted to the exterior of the sleeve. A doctor blade 662 is used to limit the radial depth of developer remaining adherent to sleeve 650 as it rotates to the nip 668 between transport roll 646 and donor roll 640. According to conventional designs, the donor roll is kept at a specific voltage, by a DC power supply 676, to attract a thin layer of toner particles from transport roll 646 in nip 668 to the surface of donor roll 640. However, here this DC voltage (Vdm) is variable, for example 20-100 Volts DC, and is controlled by a controller, for example, controller 400 (FIG. 2) as a function of a humidity measurement from a humidity sensor mounted in proximity to the toner material. For example, but not limited to, humidity sensor 560 as described with reference to FIG. 2. Either the whole of the donor roll 640, or at least a peripheral layer thereof, is preferably of material which has low electrical conductivity. The material must be conductive enough to prevent any build-up of electric charge with time, and yet its conductivity must be low enough to form a blocking layer to prevent shorting or arcing of the magnetic brush to the donor roll.

Transport roll 646 is biased by both a DC voltage source 678 and an AC voltage source 680. According to one exemplary embodiment, the DC voltage source 678 provides 20-100 Volts DC and the AC voltage source 680 provides 100-400 Volts AC. The effect of the DC electrical field is to enhance the attraction of developer material to sleeve 650. It is believed that the effect of the AC electrical field applied along the transport roll in nip 668 is to loosen the toner particles from their adhesive and tribo-electric bonds to the carrier particles. AC voltage source 680 can be applied either to the transport roll as shown in FIG. 3, or directly to the donor roll in series with supply 676.

Electrode wires 642 are disposed in the space between the belt 610 and donor roll 640. Four electrode wires are shown extending in a direction substantially parallel to the longitudinal axis of the donor roll 640. The electrode wires are made from of one or more thin (i.e. 25 to 125 micron diameter) steel, stainless steel or tungsten wires which are closely spaced from donor roll 640. The diameter of the wires shown in the figures is greatly exaggerated compared to the real wires for illustrative purposes. The distance between the wires and the donor roll 640 is approximately the thickness of the toner layer formed on the donor roll 640, or less. The wires are self-spaced from the donor roller by the thickness of the toner on the donor roller. The wire is supported in close proximity to the ends of the donor roll. This support locates the wires such that the wire and donor roll end maintain a specific required angular relationship. An alternating electrical bias is applied to the electrode wires by an AC voltage source 684. The applied AC establishes an alternating electrostatic field between the wires and the donor roller which is effective in detaching toner from the surface of the donor roller and forming a toner cloud about the wires At the region where the photoconductive belt 610 passes closest to donor roll 640, a stationary shoe 682 bears on the inner surface of the belt. The position of the shoe relative to the donor roll establishes the spacing between the donor roll and the belt. The spacing between the donor roll and photoconductive belt is preferably about 0.4 mm.

Another factor which has been found to be of importance is the speed with which the sleeve 650 is rotated relative to the speed of rotation of donor roll 640. In practice both would be driven by the same motor, but a gear train would be included in the drive system so that sleeve 650 is driven at a significantly faster surface velocity than is donor roll 640. A transport roll:donor roll speed ratio of 3:1 has been found to be particularly advantageous, and even higher relative speeds might be used in some embodiments of this disclosure. In other embodiments the speed ratio may be as low as 2:1.

As discussed above, according to one aspect of this disclosure, provided is a method of controlling the intermediate development field between a donor roll and mag roll voltage (Vdm) as a function of tribo inferred via the environment grains of water (GOW) measured in a hybrid scavenge-less development (HSD) system.

According to another aspect of this disclosure, a method to control the temperature of a developer housing as a function of GOW is disclosed, whereby the developer housing temperature setpoint is selected to maintain the tribo operating latitude associated with the developer housing. Importantly, the GOW associated with the developer housing is utilized as a surrogate measurement of the tribo-electric charge associated with the toner particles within the developer housing.

Changes in the print engine environment grains of water results in variation of the tribo-electric charge of the toner. At a fixed development field, this affects the amount of mass to the donor roll in the HSD development system. Changes in donor roll mass affect the vibrational behavior of the wires which are riding on the toner layer. This can cause image quality (IQ) defects such as fundamental strobing on the printed images. Also, the operating window for voltage breakdown between the wire and the donor roll in an HSD development system may constrain the Vdm to relatively high values at conditions of high tribo, making it more difficult to obtain optimum strobing performance According to one aspect, the disclosed control methods, apparatus and systems provide an algorithm to update the donor roll to mag roll development field voltage based on the change of the environment (GOW). Generally, when the GOW increases the tribo-electric charge of the material will decrease. Developed mass on the donor roll will vary inversely with the toner charge. The change in toner charge can be inferred from the existing tribo models. In the provided control algorithm, GOW is determined from environmental sensors in the machine, and the intermediate development voltage (Vdm) is adjusted to compensate for changes in the toner charge as inferred from GOW.

Figure 4:
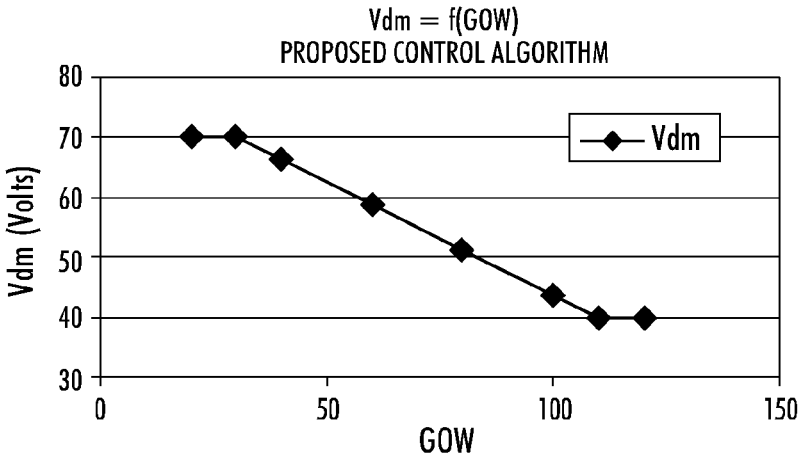
FIG. 4 is a graph of Vdm as a function of GOW according to an exemplary embodiment of this disclosure.

The exemplary embodiments disclosed function as illustrated in FIG. 4. Grains of Water is measured by machine environmental sensors (i.e., humidity sensors such as 560), and a Vdm voltage is calculated and applied.

Figure 5:
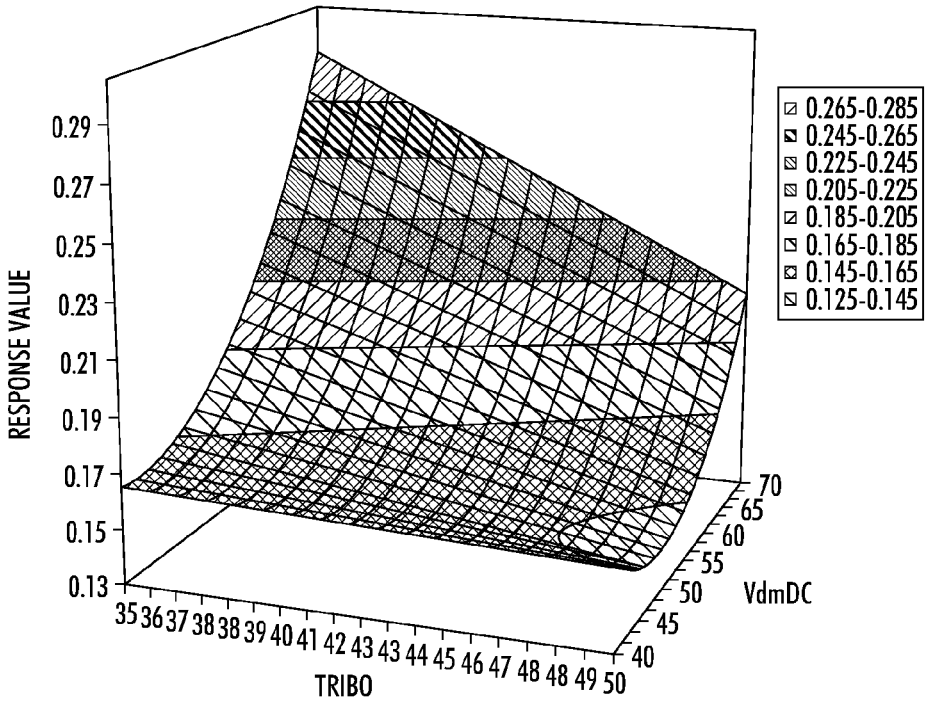
FIG. 5 is a graph of Strobing as a function of tribo and Vdm.
Figure 6:
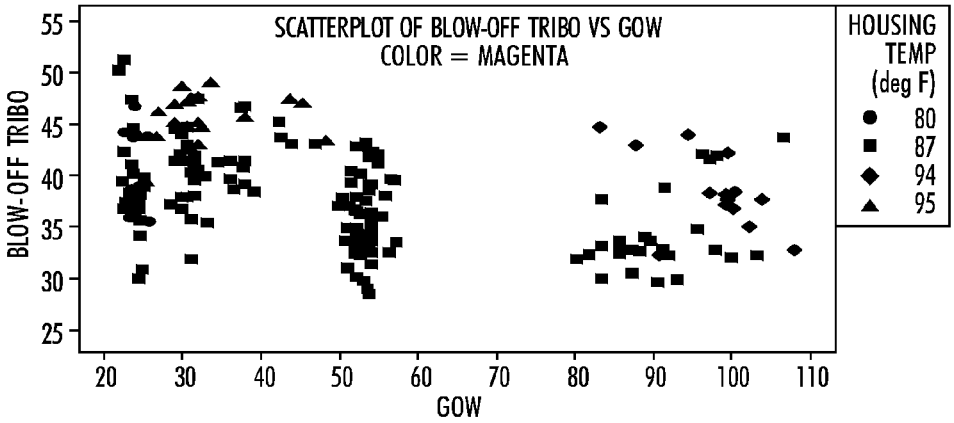
FIG. 6 is a scatterplot of Blowoff Magenta Tribo vs GOW.
Figure 7:
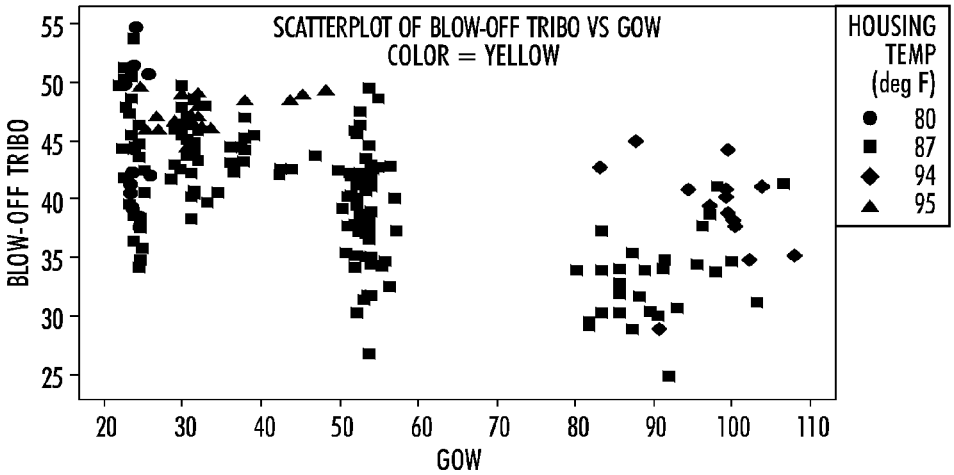
FIG. 7 is a scatterplot of Blowoff Yellow vs GOW.
Figure 8:
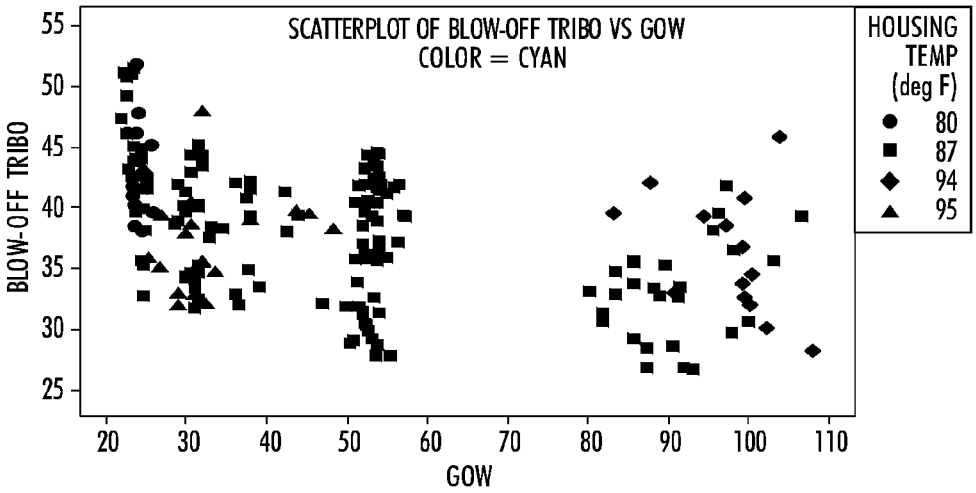
FIG. 8 is a scatterplot of Blowoff Cyan vs GOW.
Figure 9:
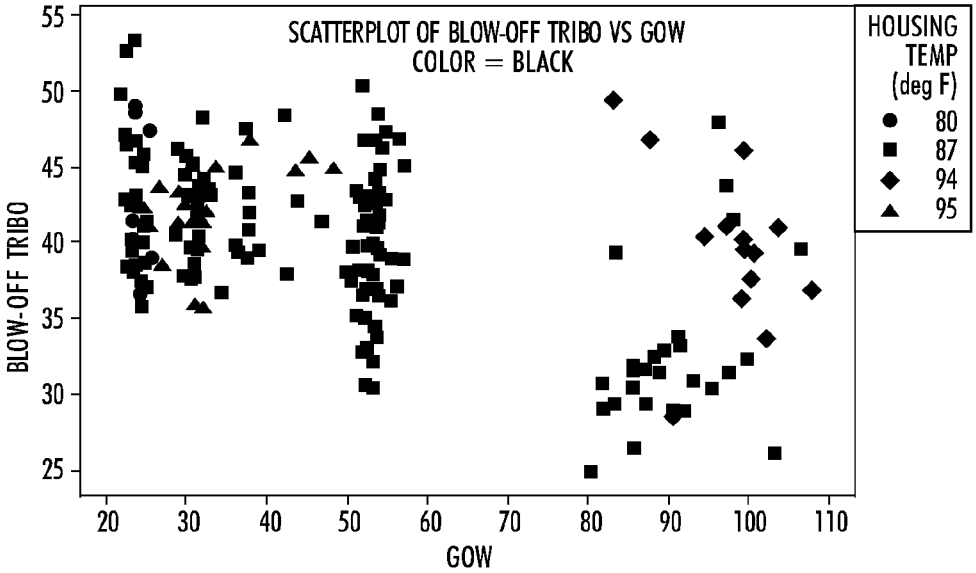
FIG. 9 is a scatterplot of Blowoff Black vs GOW.

The response curve for strobing as a function of tribo is shown in FIG. 5. Low Vdm is optimum but at higher tribo (lower GOW) a higher Vdm can be tolerated. Higher Vdm is more optimum for electrical breakdown at high tribos (lower mass on the donor roll)

To account for variations in toner tribo-electric charge, the intermediate development field Vdm is modulated as a function of a surrogate tribo-electric charge measurement in order to improve the strobing image quality defect.

The primary benefit of the disclosed method, apparatus and system are that they provide optimization latitude across multiple failure modes. In conventional systems with a fixed Vdm, the optimum Vdm setpoint is constrained by the need to accommodate the operating window for multiple failure modes; strobing (IQ), and electrical breakdown between the wire and the donor roll. With a fixed Vdm, the voltage must be maintained at a higher relative value in order to prevent breakdown between the wire and the donor. With algorithm provided, Vdm can be lowered under conditions of lower tribo in order to maintain strobing performance under conditions with greater breakdown latitude. Other image quality defects may also benefit from this change, e.g., Mottle, which has been shown to improve with lower Vdm.

In one conventional printing system, each of the four developer housings use a thermistor (one per housing) and heat pad (one per housing) to maintain a "target temperature" for that housing. For nominal conditions, the target setpoints are approximately 87 degrees F.

The developer housing thermistors provide housing temperature data to a Smart Remote interface pwb. This board provides the necessary control outputs to the heat pads to maintain the desired temperature. The housing temperatures are controlled while the system is printing and when the system is in standby.

To provide another means of tribo control, relationships have been established between humidity, temperature and tribo. In humid ambient environments (high grains of water), the resulting low tribo material condition results in several image quality issues (high background, spitting, etc.). Conversely, in relatively dry ambient environments the high tribo can results in reduced developability performance. FIGS. 6-9 show the relationship between GOW and material Tribo with the housing at fixed setpoints. We see a relatively tight tribo distribution at the lower temperatures at lower GOW. At a constant temperature setpoint of 87 degrees, we see a significant slope to the tribo as GOW increases or decreases. FIGS. 6-9 also show that at the higher GOW readings, the higher temperature setpoint significantly reduces the sensitivity of the tribo to ambient GOW.

Figure 10:
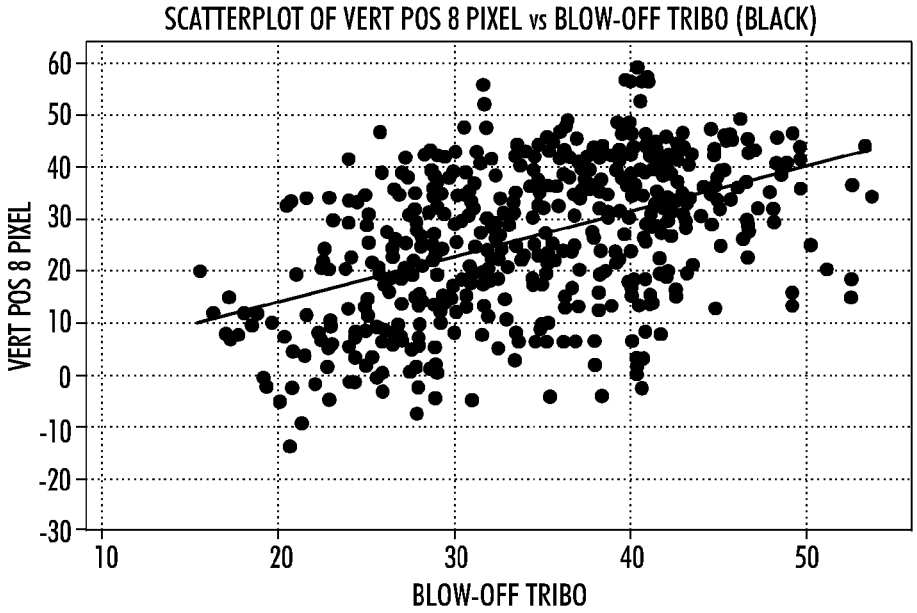
FIG. 10 is a scatterplot of image quality (IQ) vs Black Tribo (line width and mottle).

FIG. 10 shows the relationship between tribo and Image Quality.

Figure 11:
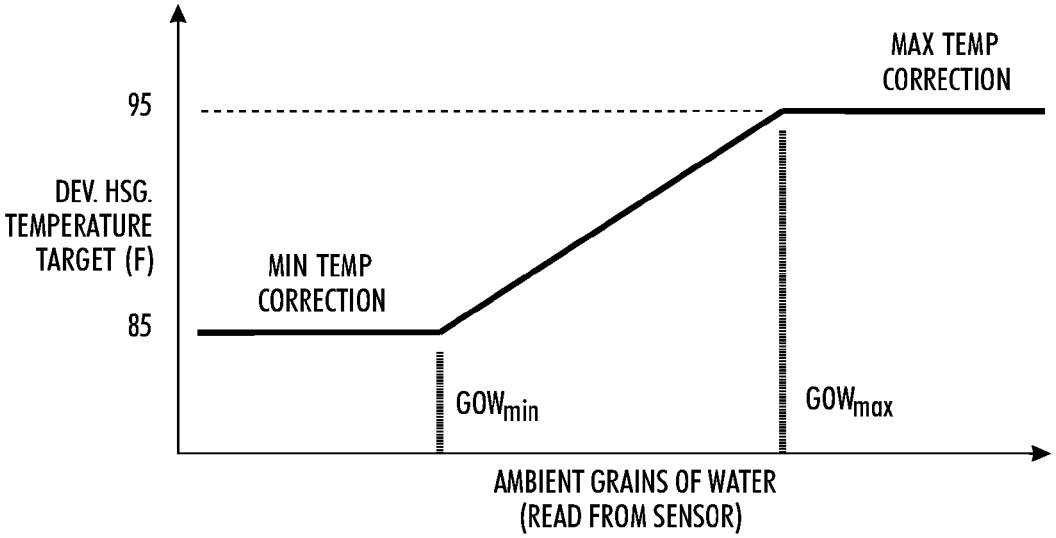
FIG. 11 is a graph of a development housing temperature target vs Ambient GOW, according to one exemplary embodiment of this disclosure.

Further disclosed are manners of utilizing an ambient grains of water sensor as an input, and adjusting the Developer Housing target temperature as described in FIG. 11.

All of the parameters can be NVM values that can be easily adjusted to optimize the feature. This allows the system to dynamically adjust for different environments both while the system is printing and in standby. This has the advantage of accounting for print shop environments which can vary significantly during the course of a day. Compensating for these effects with temperature provides improved tribo latitude.

The system operates as follows.

GOW Temperature Setpoint Correction:

If Ambient GOW Reading<$GOW_{min}$, Then Temp Target=Min Temp Correction

If Ambient GOW Reading>$GOW_{max}$, Then Temp Target=Max Temp Correction

If $GOW_{min}$<Ambient GOW Reading<$GOW_{max}$, Then Temp Target=Min Temp Correction+(Ambient GOW Reading−$GOW_{min}$)*[(Max Temp Correction-Min Temp Correction)/($GOW_{max}$−$GOW_{min}$)]

The unique aspect of this approach is to update the Developer Housing temperature setpoint as a function of ambient grains of water.

This overall control strategy provides better tribo performance (developability) over a greater range of environmental conditions and in environments that experience significant changes in conditions over time.

To date, alternative approaches do not directly utilize existing machine sensors and actuators to manage the tribo operating latitude. This disclosure, and the exemplary embodiments herein, leverage existing machine functionality with a unique approach to optimizing tribo performance.

Figure 12:
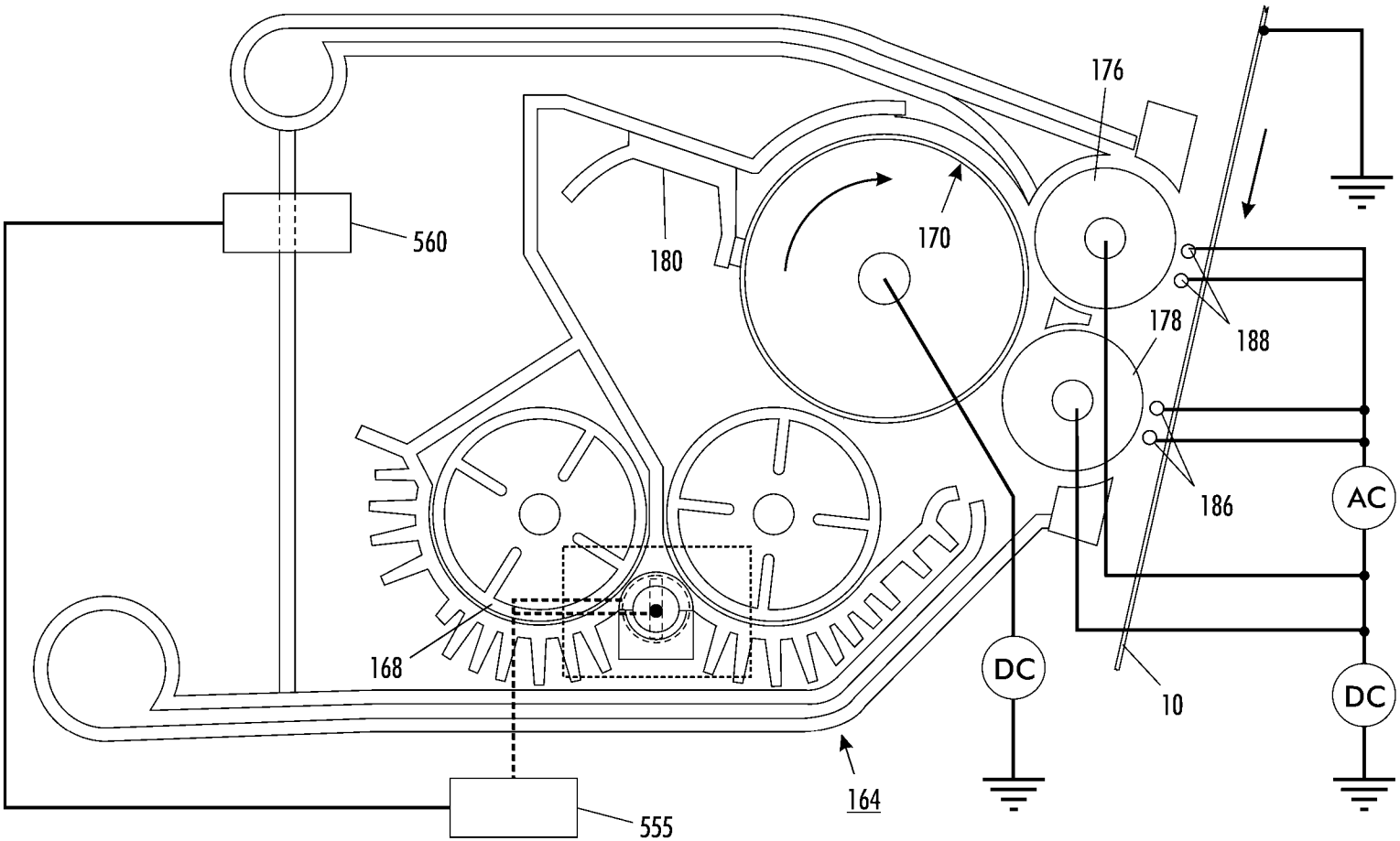
FIG. 12 shows an exemplary embodiment of a development system including a temperature control system according to an exemplary embodiment of this disclosure.

With reference to FIG. 12, disclosed is a development system according to one exemplary embodiment of this disclosure. The development system includes a GOW sensor 560, a climate control system and a controller which executes program instructions to measure the GOW associated with the development system and control the temperature of the developer toner as a function of the measured GOW.

As previously stated, according to one exemplary embodiment, the development system 132 includes a climate system, associated with a reservoir 164, for maintaining a supply of developer material at a predefined setpoint temperature, the setpoint temperature a function of the measured GOW from GOW sensor 560. The climate system includes a heating element 405 and optionally a cooling element 403 which supplies cooling air, for example between 50° to 60° F., from an external source. The air cools contacts thermal fins 411 which are integrated into the housing to improve cooling of the housing when required. Heating element 405 may be composed of a dual heat rod assembly 412 to improve print quality stability by mitigating tribo variations.

The climate system further includes a sensor 407 and sensor 408 associated with each heating unit 415 and 416 for sensing the temperature of the supply of developer material in an inboard position and an outboard position. The climate/tribo control system further includes a controller 555 in communication with the GOW sensor, heating units 415 and 416, and/or the cooling element 403 and temperature sensors 407 and 408. The controller 555 selectively activates/deactivates heating units 415 and 416 and/or the cooling element according to a temperature setpoint correlated with the measured GOW of GOW sensor 560.

Figure 13:
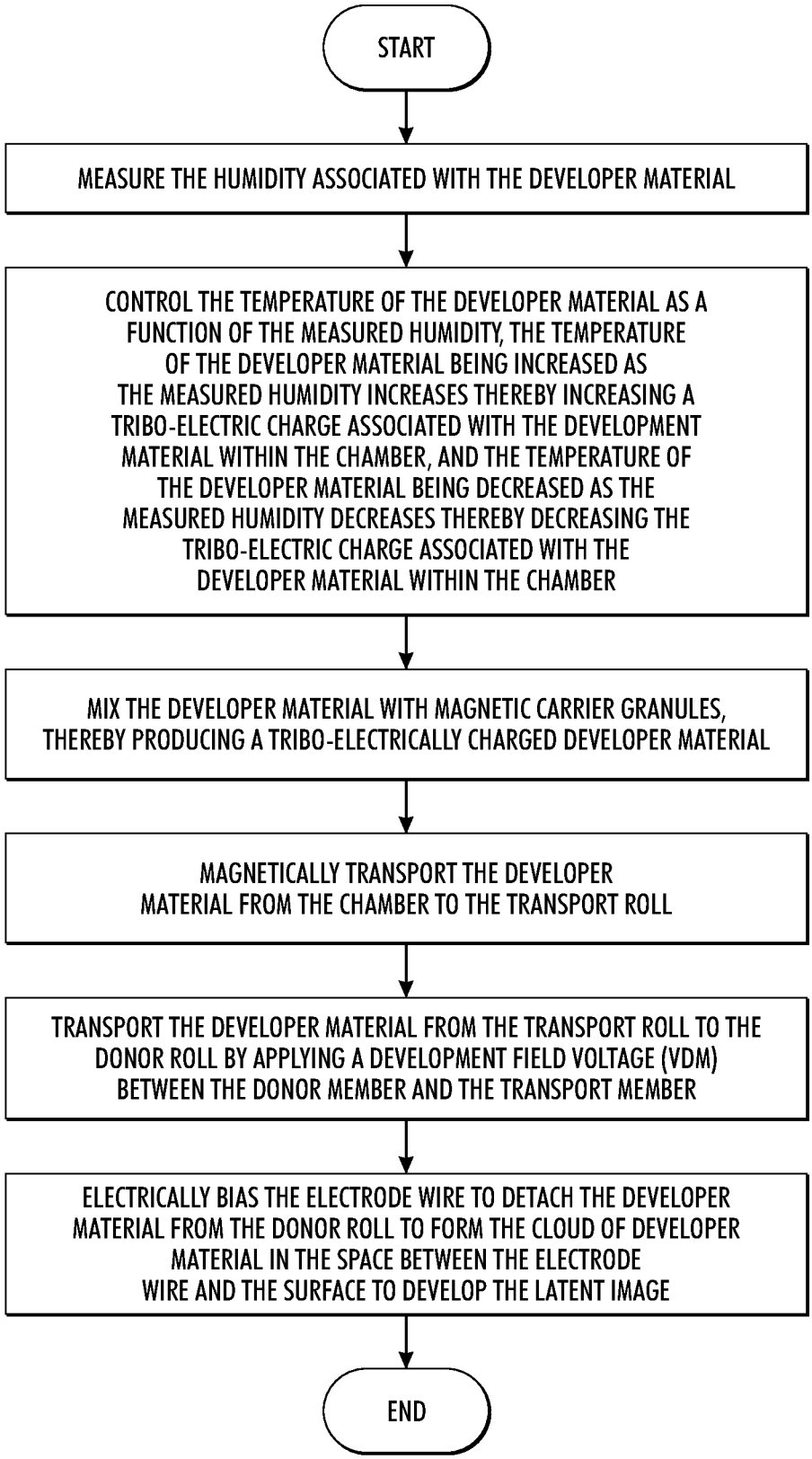
FIG. 13 is a flow chart of a method of controlling the tribo associated with a developer material by controlling the temperature of the developer material as a function of the GOW associated with the developer material.

FIG. 13 is a flow chart of an exemplary method of controlling the tribo associated with development material as a function of a GOW measurement, by controlling the temperature of the development material as a function of the measured GOW. Substantively, the method includes developing a latent image recorded on a surface using a development system as described with reference to FIGS. 1, 2, 3, 11 and 12. The development system includes a chamber storing a supply of developer material therein, a transport member, a donor member, an electrode wire, a temperature control system configured to control a temperature associated with the developer material to a target temperature and a humidity sensor configured to measure the humidity associated with the developer material. The transport member is configured to transport the developer material to the donor member, and the donor member and electrode wire are configured to form a cloud of developer material in a space between the electrode wire and the surface to develop the latent image on the surface. The method comprises:

a) measuring the humidity associated with the developer material;

b) the temperature control system controlling the temperature of the developer material as a function of the measured humidity, the temperature of the developer material being increased as the measured humidity increases thereby increasing a tribo-electric charge associated with the development material within the chamber, and the temperature of the developer material being decreased as the measured humidity decreases thereby decreasing the tribo-electric charge associated with the developer material within the chamber;

c) mixing the developer material with magnetic carrier granules, thereby producing a tribo-electrically charged developer material;

d) magnetically transporting the developer material from the chamber to the transport roll;

e) transporting the developer material from the transport roll to the donor roll by applying a development field voltage (Vdm) between the donor member and the transport member; and f) electrically biasing the electrode wire to detach the developer material from the donor roll to form the cloud of developer material in the space between the electrode wire and the surface to develop the latent image.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A method of developing a latent image recorded on a surface using a development system, the development system including a chamber storing a supply of developer material therein, a transport member, a donor member, an electrode wire, a temperature control system configured to control a temperature associated with the developer material to a target temperature and a humidity sensor configured to measure the humidity associated with the developer material, wherein the transport member is configured to transport the developer material to the donor member, and the donor member and electrode wire are configured to form a cloud of developer material in a space between the electrode wire and the surface to develop the latent image on the surface, the method comprising:

a) measuring the humidity associated with the developer material;

b) the temperature control system controlling the temperature of the developer material as a function of the measured humidity, the temperature of the developer material being increased as the measured humidity increases thereby increasing a tribo-electric charge associated with the development material within the chamber, and the temperature of the developer material being decreased as the measured humidity decreases thereby decreasing the tribo-electric charge associated with the developer material within the chamber, wherein the function includes a maximum temperature value $T_{max}$, a minimum temperature value $T_{min}$, a maximum humidity value $GOW_{max}$, and a minimum humidity value $GOW_{min}$, and if the measured humidity is less than $GOW_{min}$, then the temperature associated with the developer material is controlled to target temperature $T_{min}$;

if the measured humidity is greater than $GOW_{max}$, then the temperature associated with the developer material is controlled to target temperature $T_{max}$;

c) mixing the developer material with magnetic carrier granules, thereby producing a tribo-electrically charged developer material;

d) magnetically transporting the developer material from the chamber to the transport roll;

e) transporting the developer material from the transport roll to the donor roll by applying a development field voltage (Vdm) between the donor member and the transport member; and f) electrically biasing the electrode wire to detach the developer material from the donor roll to form the cloud of developer material in the space between the electrode wire and the surface to develop the latent image.

2. The method according to claim 1, wherein the transport member is a multi-polar magnetic roll, the donor member includes a relatively non-conductive roll, and step e) further comprises:

applying a dc voltage between the donor member and the transport member.

3. The method according to claim 1, wherein the temperature control system includes one or more of a temperature sensor, a heating element and a cooling element.

4. The method according to claim 1, wherein if the measured humidity is greater than or equal to $GOW_{min}$ and less than or equal to $GOW_{max}$, then the temperature associated with the developer material is controlled to a target temperature equal to $$T_{min}+(\text{measured humidity}-GOW_{min})*[(T_{max}-T_{min})/(Gow_{max}-GOW_{min})].$$

5. The method according to claim 1, wherein the humidity is measured in one of absolute humidity and relative humidity.

6. The method according to claim 1, wherein the humidity sensor measures ambient humidity associated with the developer material.

7. An apparatus for developing a latent image recorded on a surface comprising:

a housing defining a chamber storing a supply of developer material therein;

a transport member operatively associated with the chamber and configured to attract the developer material to a surface of the transport member;

a donor member operatively associated with the transport member and configured to attract developer material from the surface of the transport member to a surface of the donor member;

an electrode wire operatively associated with the donor member and the surface, the electrode wire, donor member and surface configured to transfer developer material from the donor member to the surface, the electrode wire positioned between the donor member and the surface;

a humidity sensor configured to measure the humidity associated with the developer material;

a temperature control system configured to control a temperature associated with the developer material to a target temperature; and a controller configured to execute instructions to develop a latent image recorded on a surface, the instructions including:

a) measuring the humidity associated with the developer material;

b) the temperature control system controlling the temperature of the developer material as a function of the measured humidity, the temperature of the developer material being increased as the measured humidity increases thereby increasing a tribo-electric charge associated with the development material within the chamber, and the temperature of the developer material being decreased as the measured humidity decreases thereby decreasing the tribo-electric charge associated with the developer material within the chamber, wherein the function includes a maximum temperature value $T_{max}$, a minimum temperature value $T_{min}$, a maximum humidity value $GOW_{max}$, and a minimum humidity value $GOW_{min}$ and if the measured humidity is less than $GOW_{min}$, then the temperature associated with the developer material is controlled to target temperature $T_{min}$;

if the measured humidity is greater than $GOW_{max}$, then the temperature associated with the developer material is controlled to target temperature $T_{max}$;

c) mixing the developer material with magnetic carrier granules, thereby producing a tribo-electrically charged developer material;

d) magnetically transporting the developer material from the chamber to the transport roll;

e) transporting the developer material from the transport roll to the donor roll by applying a development field voltage (Vdm) between the donor member and the transport member; and f) electrically biasing the electrode wire to detach the developer material from the donor roll to form the cloud of developer material in the space between the electrode wire and the surface to develop the latent image.

8. The apparatus according to claim 7, wherein the transport member is a multi-polar magnetic roll, the donor member includes a relatively non-conductive roll, and step e) further comprises:

applying a dc voltage between the donor member and the transport member.

9. The apparatus according to claim 7, wherein the temperature control system includes one or more of a temperature sensor, a heating element and a cooling element.

10. The apparatus according to claim 7, wherein if the measured humidity is greater than or equal to $GOW_{min}$ and less than or equal to $GOW_{max}$, then the temperature associated with the developer material is controlled to a target temperature equal to $$T_{min}+(\text{measured humidity}-GOW_{min})*[(T_{max}-T_{min})/(Gow_{max}-GOW_{min}].$$

11. The apparatus according to claim 7, wherein the humidity is measured in one of absolute humidity and relative humidity.

12. The apparatus according to claim 7, wherein the humidity sensor measures ambient humidity associated with the developer material.

13. The apparatus according to claim 7, wherein the developer material includes magnetic carrier granules which produce tribo-electrically charged developer material and the transport member is configured to magnetically attract the tribo-electrically charged developer.

14. The apparatus according to claim 7, further comprising a plurality of electrode wires operatively associated with the donor member.

15. The apparatus according to claim 7, further comprising a plurality of donor members operatively associated with the transport member and configured to attract developer material from the surface of the transport member to a surface of each donor member.

16. A xerographic printing system comprising:

a photoreceptor member;

a raster output scanner (ROS) that generates a latent image on a portion of the photoreceptor member as it moves past the ROS;

a development station for developing the latent image with a developer material to produce a developed image, the development station comprising:

an image transfer station for transferring the developed image to a substrate;

a housing defining a chamber storing a supply of the developer material therein;

a transport member operatively associated with the chamber and configured to attract the developer material to a surface of the transport member;

a donor member operatively associated with the transport member and configured to attract developer material from the surface of the transport member to a surface of the donor member;

an electrode wire operatively associated with the donor member and the photoreceptor member, the electrode wire, donor member and photoreceptor member configured to transfer the developer material from the donor member to the photoreceptor surface, the electrode wire positioned between the donor member and the photoreceptor; and a humidity sensor configured to measure the humidity associated with the developer material;

a temperature control system configured to control a temperature associated with the developer material to a target temperature; and a controller configured to execute instructions to develop a latent image recorded on a surface, the instructions including:

a) measuring the humidity associated with the developer material;

b) the temperature control system controlling the temperature of the developer material as a function of the measured humidity, the temperature of the developer material being increased as the measured humidity increases thereby increasing a tribo-electric charge associated with the development material within the chamber, and the temperature of the developer material being decreased as the measured humidity decreases thereby decreasing the tribo-electric charge associated with the developer material within the chamber wherein the function includes a maximum temperature value $T_{max}$, a minimum temperature value $T_{min}$, a maximum humidity value $GOW_{max}$, and a minimum humidity value $GOW_{min}$, and if the measured humidity is less than $GOW_{min}$, then the temperature associated with the developer material is controlled to target temperature $T_{min}$;

if the measured humidity is greater than $GOW_{max}$, then the temperature associated with the developer material is controlled to target temperature $T_{max}$;

c) mixing the developer material with magnetic carrier granules, thereby producing a tribo-electrically charged developer material;

d) magnetically transporting the developer material from the chamber to the transport roll;

e) transporting the developer material from the transport roll to the donor roll by applying a development field voltage (Vdm) between the donor member and the transport member; and f) electrically biasing the electrode wire to detach the developer material from the donor roll to form the cloud of developer material in the space between the electrode wire and the surface to develop the latent image;

a transfer station for transferring the developer material from the photoreceptor to a substrate; and a fusing station configured to fuse the transferred developer material to the substrate.

17. The xerographic printing system according to claim 16, wherein the transport member is a multi-polar magnetic roll and the donor member is a relatively non-conductive roll.

18. The xerographic printing system according to claim 16, wherein the electrical field controller is configured to apply a dc voltage between the donor member and the transport member.

19. The xerographic printing system according to claim 16, the development station further comprising a plurality of electrode wires operatively associated with the donor member.

20. The xerographic printing system according to claim 16, the development station further comprising a plurality of donor members operatively associated with the transport member and configured to attract developer material from the surface of the transport member to a surface of each donor member.

* * * * *